US011638867B2

(12) United States Patent
Witherill

(10) Patent No.: US 11,638,867 B2
(45) Date of Patent: May 2, 2023

(54) SIMULATED SOCCER GAME DEVICE AND METHOD

(71) Applicant: Hand and Fingar, LLC, Chandler, AZ (US)

(72) Inventor: Nicholas Witherill, Scottsdale, AZ (US)

(73) Assignee: Hand and Fingar, LLC, Chandler, AZ (US)

( * ) Notice: Subject to any disclaimer, the term of this patent is extended or adjusted under 35 U.S.C. 154(b) by 0 days.

(21) Appl. No.: 16/742,877

(22) Filed: Jan. 14, 2020

(65) Prior Publication Data

US 2020/0222795 A1 Jul. 16, 2020

Related U.S. Application Data

(60) Provisional application No. 62/792,876, filed on Jan. 15, 2019.

(51) Int. Cl.
*A63F 7/06* (2006.01)
*A63F 7/24* (2006.01)

(52) U.S. Cl.
CPC ..... *A63F 7/0616* (2013.01); *A63F 7/2436* (2013.01); *A63F 7/2481* (2013.01)

(58) Field of Classification Search
CPC ..... A63F 7/00; A63F 7/0017; A63F 7/0005; A63F 7/0616; A63F 7/2481; A63F 7/2436
USPC ..... 273/108.1, 108.5, 129 W, 129 K, 129 L, 273/317, 317.1, 317.5; 473/505, 518, 473/450, 458, 464
See application file for complete search history.

(56) References Cited

U.S. PATENT DOCUMENTS 160,234 A * 2/1875 Reidenger ..... A63F 9/16 273/108
362,898 A * 5/1887 Muringer ..... A63F 9/16 273/108
429,639 A * 6/1890 Reiz ..... A63F 9/16 273/108
648,336 A * 4/1900 Bellamy ..... A63F 7/2436 273/317.2
1,763,205 A * 6/1930 Winbigler ..... A63F 7/0628 273/317.2
2,206,213 A * 7/1940 Weidemann ..... A63D 3/00 473/107
3,086,778 A * 4/1963 Maurer ..... A63F 7/249 273/108.55
3,582,079 A * 6/1971 Breslow ..... A63F 9/02 273/108

(Continued)

*Primary Examiner* — Sebastiano Passaniti
(74) *Attorney, Agent, or Firm* — Snell & Wilmer LLP

(57) ABSTRACT

A game device is disclosed herein. The game device is a portable simulated soccer game that provides a substantially rectangular rigid planar surface having indicia of a soccer field disposed thereon. Simulated players are arranged on the field by mating with one of an array of apertures. The game device includes a pair of nets to be placed in a location corresponding with the simulated soccer field. A simulated soccer ball is used by a user to score on an opponent's net. A sleeve is provided having optional attachment features that are used to propel the ball. A user decides the arrangement of simulated players on the field with respect to the ball. The game device provides a game where orientation of simulated players impedes the ability to score points.

13 Claims, 4 Drawing Sheets

(56) References Cited

U.S. PATENT DOCUMENTS 3,680,864 A * 8/1972 Peterson ..... A63F 9/16 273/110
3,834,703 A * 9/1974 Dlouhy ..... A63F 7/0608 273/317.7
3,995,859 A * 12/1976 Goldfarb ..... A63F 7/0652 273/129 R
4,012,040 A * 3/1977 Fernandes ..... A63F 7/068 273/108.56
4,094,507 A * 6/1978 Kauffmann ..... A63F 7/386 273/110
4,098,507 A * 7/1978 Hudon ..... A63F 7/0628 273/108.21
4,173,338 A * 11/1979 Barnett ..... A63F 7/3065 273/108.1
4,261,568 A * 4/1981 Such ..... A63F 7/0668 273/108.5
4,274,635 A * 6/1981 Pakogian ..... A63F 7/0608 273/108.5
4,387,895 A * 6/1983 Steel ..... A63B 60/40 473/518
4,872,679 A * 10/1989 Bohaski ..... A63F 7/0668 273/317.5
5,092,595 A * 3/1992 Daravina ..... A63F 7/0668 273/108.5
5,242,164 A * 9/1993 Nicoll ..... A63F 7/0668 273/108.5
5,372,364 A * 12/1994 Arroyo ..... A63F 7/0668 273/108.5
5,431,397 A * 7/1995 Eckel ..... A63F 7/0668 273/108.1
5,839,979 A * 11/1998 De Genty ..... A63B 60/40 473/464
5,853,172 A * 12/1998 Yetken ..... A63F 7/0668 273/108.5
5,944,433 A * 8/1999 O'Mara ..... B43K 23/008 401/7
6,247,992 B1 * 6/2001 Higgins, III ..... A63H 1/30 446/250
6,419,224 B1 * 7/2002 Tsai ..... A63D 15/04 273/108.1
7,204,487 B1 * 4/2007 Pohl ..... A63F 7/06 273/108.1
7,325,803 B1 * 2/2008 Miranda ..... A63F 7/0668 273/108.41
7,484,328 B1 * 2/2009 Daugherty ..... A01M 3/02 43/137
8,568,191 B2 * 10/2013 Rehkemper ..... A63F 9/16 446/259
2015/0091249 A1 * 4/2015 Nally ..... A63F 7/0612 273/108.1
2017/0173432 A1 * 6/2017 Lam ..... A63F 7/2436

* cited by examiner

SIMULATED SOCCER GAME DEVICE AND METHOD

CROSS-REFERENCE TO RELATED APPLICATION(S)

The present application is related to and claims priority to U.S. Provisional Patent Application No. 62/792,876 filed Jan. 15, 2019 which is incorporated by reference herein in its entirety.

TECHNICAL FIELD

The present disclosure relates generally to board games and, more particularly, to football based board games.

BACKGROUND

Soccer is a football game played on a large rectangular field outdoors. Two opposing teams defend a goal area on their respective ends of the field. A single ball is used in the game, where the players may not use their hands to maneuver or propel the ball. The objective of the game is for one team to get the ball into the opposing teams goal area. The respective goal areas may be guarded by a single player, who may be allowed to use hands to prevent the ball from entering the goal area.

As soccer is a popular sport throughout the world, a desire to play is often left unsatisfied. Due to limited space, players, time, and resources, many soccer enthusiasts are left only to spectate the game. Strong affinity for soccer has manifested into various outlets including backyard play, videogames, and playing cards. Soccer enthusiasts are known to play imaginary soccer games where players assemble a fictitious team of known professional players. Points and statistics from professional games may generally used to determine a winner.

SUMMARY

In view of the foregoing disadvantages inherent in the known soccer board game art, the present disclosure provides a novel soccer game device and method. The general purpose of the present disclosure, which will be described subsequently in greater detail, is to provide a soccer game device and method.

A game device is disclosed herein. The game device includes a substantially rectangular rigid planar surface having a plurality of apertures disposed thereon. A plurality of elongate pieces are included such that each is sized and shaped to mate with any of the plurality of apertures. Mating of the elongate pieces to the surface enables the pieces to maintain a perpendicular orientation to the substantially rectangular rigid planar surface. A simulated soccer field is sized and dimensioned to be disposed on the substantially rectangular rigid planar surface. A pair of nets corresponding to the field of play are configured to attach to the planar surface. A simulated soccer ball is included with the game device and scaled accordingly with respect to the simulated soccer field. A sleeve that is to be worn by the user is included for physical communication with the simulated soccer ball.

According to another embodiment, a game device is also disclosed herein. The game device includes a providing a game device, attaching a plurality of elongate pieces to a substantially rectangular rigid planar surface, moving a simulated soccer ball towards of a pair of nets, and (optionally) rearranging the plurality of elongate pieces.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

The various embodiments of the present invention will hereinafter be described in conjunction with the appended drawings, wherein like designations denote like elements.

DETAILED DESCRIPTION

Figure 1:
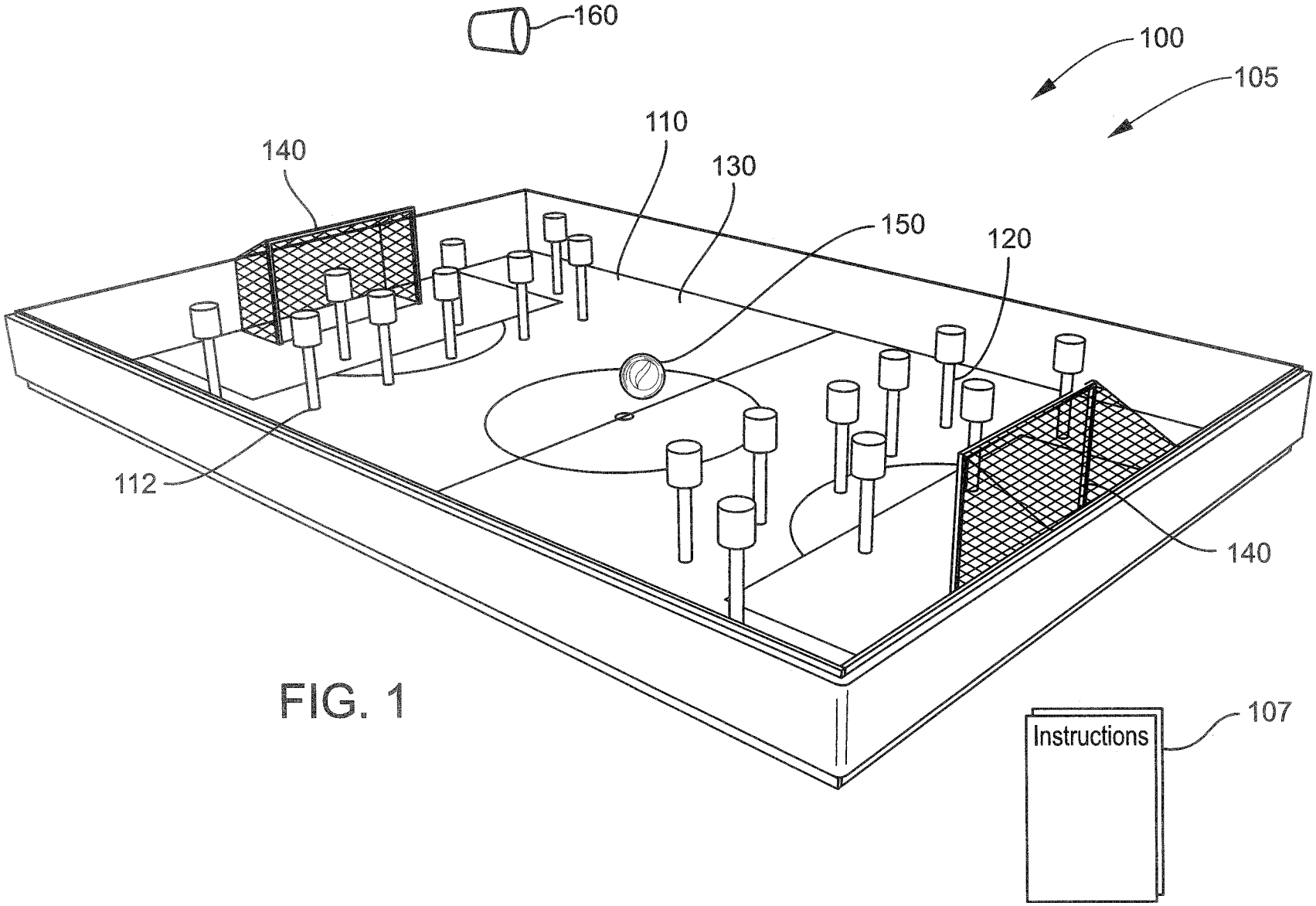
FIG. 1 is a perspective view of the game device according to an embodiment of the disclosure.

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials Generally, the game device is a tabletop simulated soccer game. The game device is a scaled soccer field having stationary simulated players and a simulated soccer ball. A rectangular rigid plane is provided that includes multiple holes that are configured to mate with simulated players. In one embodiment, a piece of material having indicia that corresponds to a soccer field is sized to be placed on the rectangular plane. The material may be removed and replaced with material that includes different indicia, for playing a different game having different rules. A pair of nets are included and attachable to opposing ends of the simulated field.

The game device further includes a ball propelling sleeve accessory that may be worn by the users. In one embodiment, the sleeve includes simple aiming indicia. In another embodiment, the sleeve is attached to a launching mechanism that transmits momentum to the simulated soccer ball. The launching mechanism may utilize elastic properties, and may be manually manipulated by the user's fingers. In another embodiment the launching mechanism may include a flywheel configured to store rotational energy. Rules may dictate that only the energy stored in the flywheel may be used through the course of the game. Further embodiments of the launching mechanism include electricity power and gravity powered means, such as motors and pendulums.

Referring now more specifically to the drawings by numerals of reference, there is shown in FIGS. 1-4, various views of a game device 100.

FIG. 1 shows a game device according to an embodiment of the present disclosure.

Here, the game device may be beneficial to play a game of simulated soccer. As illustrated, the game device 100 may include a substantially rectangular rigid planar surface 110. The substantially rectangular planar surface 110 includes a plurality of apertures 112. A plurality of elongate pieces 120 having at least one end sized to mate with any of the plurality of apertures 112 in shown. These enable the elongate pieces 120 to maintain a perpendicular orientation to the substantially rectangular rigid planar surface 110. A simulated soccer field 130 is sized and dimensioned to be disposed on the substantially rectangular rigid planar surface 110. A pair of nets 140 are included and configured to attach to the substantially rectangular rigid planar surface 110. The pair of nets 140 may comprise a rigid material. Alternatively, the nets may comprise of a resilient material, fabric, and any combination thereof. A simulated soccer ball 150 that is substantially scaled with respect to the simulated soccer field 130 is shown. A sleeve 160 that is configured to be worn by a user and used to propel the simulated soccer ball 150.

According to one embodiment, the game device 100 may be arranged as a kit 105. In particular, the game device 100 may further include a set of instructions 107. The instructions 107 may detail functional relationships in relation to the structure of the game device 100 such that the game device 100 can be used, maintained, or the like, in a preferred manner.

Figure 2:
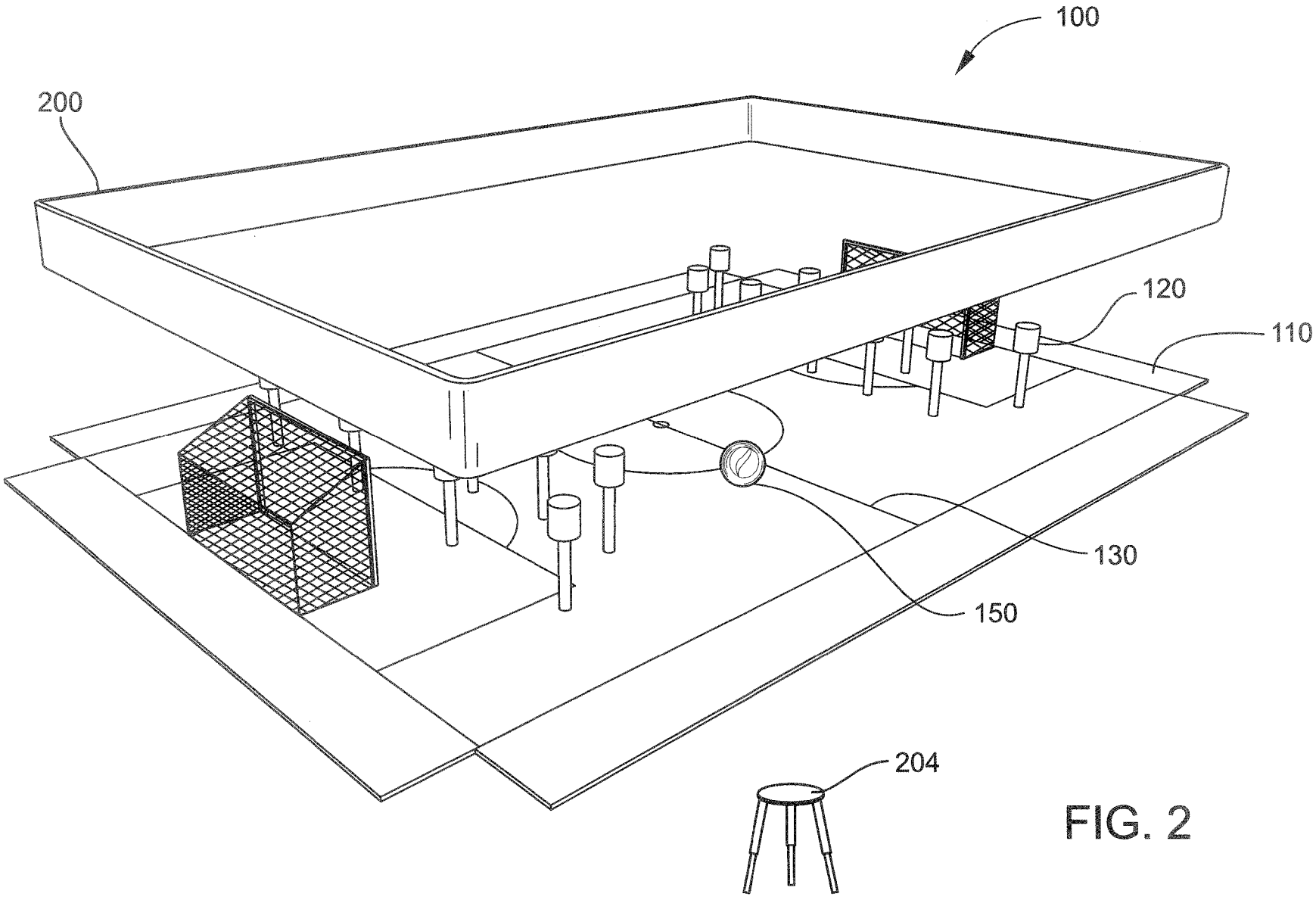
FIG. 2 is a perspective view of the game device of FIG. 1, according to an embodiment of the present disclosure.

FIG. 2 shows the game device of FIG. 1, according to an embodiment of the present disclosure. As above, the game device 100 may include a substantially rectangular rigid planar surface 110 having a plurality of apertures 112 (FIG. 3) configured to retain a plurality of elongate pieces 120. It should be noted that the simulated soccer field 130 is designed to allow the passage of the plurality of elongate pieces 120 into the plurality of apertures 112 on the substantially rectangular rigid planar surface 110. To accommodate the plurality of elongate pieces 120, the simulated soccer field 130 may include field apertures (not shown). Alternatively, the simulated soccer field 130 may comprise a material configured to allow the plurality of elongate pieces 120 to pass through without field apertures. The simulated soccer field 130 may be removably replaceable from the substantially rectangular rigid planar surface 110 allowing a user to change the gameplay. The plurality of elongate pieces 120 act as simulated players on the simulated soccer field 130. The substantially rectangular rigid planar surface 110 may include supports 204 that are configured to elevate the game. The supports 204 may be adjustable such that a user may raise and lower the simulated field from the floor as per preference. The supports 204 may utilize telescoping functionality that allows an analogue modification of distance from the floor. Supports 204 may be integrated to the substantially rectangular rigid planar surface 110 through a pivot or any mechanical means. An elastic border 200 may be configured to be disposed along a periphery of the substantially rectangular rigid planar surface 110. Generally speaking, the elastic border 200 is designed to define the area where the game device 100 is played. It is preferable that the simulated soccer ball 150 remains on the simulated soccer field 130, thus the elastic border 200 is provided for optional attachment.

Figure 3:
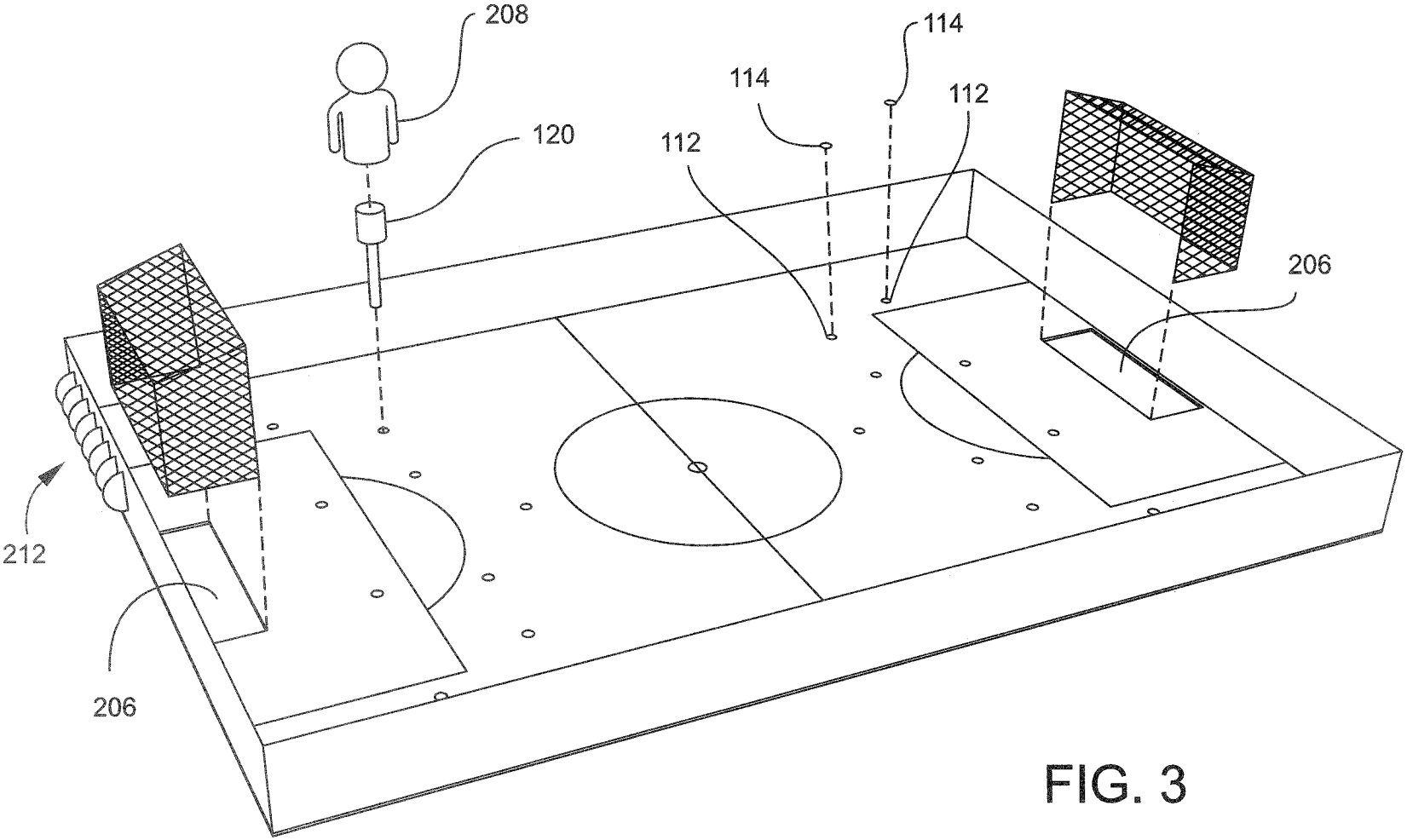
FIG. 3 is a perspective view of the game device of FIG. 1, according to an embodiment of the present disclosure.

FIG. 3 is a perspective view of the game device of FIG. 1, according to an embodiment of the present disclosure. Here shown is another view of the game device 100 that illustrates the substantially rectangular rigid planar surface 110 (FIG. 1) without the simulated soccer field 130 (FIG. 2). As pictured, the plurality of apertures 112 define potential locations for the plurality of elongate pieces 120. The plurality of elongate pieces 120 act as simulated soccer players when mated with the plurality of apertures 112 that are disposed on the substantially rectangular rigid planar surface 110 (FIG. 1). To further the simulation, the game device may include ornamental dressings 208 that are configured to attach to the plurality of elongate pieces 120. In some embodiments, the ornamental dressings 208 have the appearance of a professional soccer player. The ornamental dressings 208 may include traditional soccer player attire including numbering and other markings of a professional team. In other embodiments, the ornamental dressings 208 are customizable. Possible customizations include fictitious figures, creatures, superheroes, and any conceived effigy.

Orientation of the elongate pieces 120 about the game device 100 may be dynamic. Each of the plurality of apertures 112 include a corresponding plug 114. The plugs 114 are sized and dimensioned to mate with the plurality of apertures 112. The plugs 114 create a flush surface with the substantially rectangular rigid planar surface 110 (FIG. 1) when mated with the plurality of apertures 112. A user may mate the plurality of elongate pieces 120 with the plurality of apertures 112 that remain unmated with the plugs 114. It may be obvious that the plugs 114 are used to fill the plurality of apertures 112 such that a level playing surface is maintained. Reconfiguration of the plurality of elongate pieces 120 to a desired formation by may be achieved replacing the plugs 114 from the plurality of apertures 112 with the plurality of elongate pieces 120. Desired formations of the plurality of elongate pieces 120 may be set in predetermined intervals during play, as per predefined rules.

For example, as depicted in FIG. 3, the planar surface of the game device may comprise four rows of apertures. A first of the four rows of apertures may extend orthogonal to a sideline of the simulated soccer field and across a first penalty area of the simulated soccer field. A second of the four rows of apertures may extend orthogonal to the sideline and across a first penalty arc of the simulated soccer field. A third of the four rows of apertures may extend orthogonal to the sideline of the simulated soccer field and across a second penalty area of the simulated soccer field. A fourth of the four rows of apertures may extend orthogonal to the sideline and across a second penalty arc of the simulated soccer field. The first penalty area may encompass two of the apertures of the first row. The second penalty area may encompass two of the apertures of the third row.

The game device 100 may further include conceptual sizes, designs and features. In some embodiments, at least one catch basin 206 is disposed on the substantially rectangular rigid planar surface 110 (FIG. 1). The catch basin 206 may be paired and disposed on opposing ends of the simulated soccer field 130 (FIG. 1) respective to a goal area. The pair of nets 140 (FIG. 1) may be disposed over the paired catch basins 206 respectively. In this orientation, when the simulated soccer ball 150 (FIG. 1) is retained in the catch basin 206 a goal is defined, and a point is awarded. A scoring apparatus 212 may be included for accounting points received. In some embodiments, the scoring apparatus 212 is disposed on opposing ends of the game device 100. The scoring apparatus 212 may comprise a simple counting mechanism, such as abacus. In other designs, the scoring apparatus 212 may comprise electronic means of accounting for points. Electronic versions of the scoring apparatus 212 may range in complexity from manual input when a point is awarded, to automatic detection of points through the use of technology.

Figure 4:
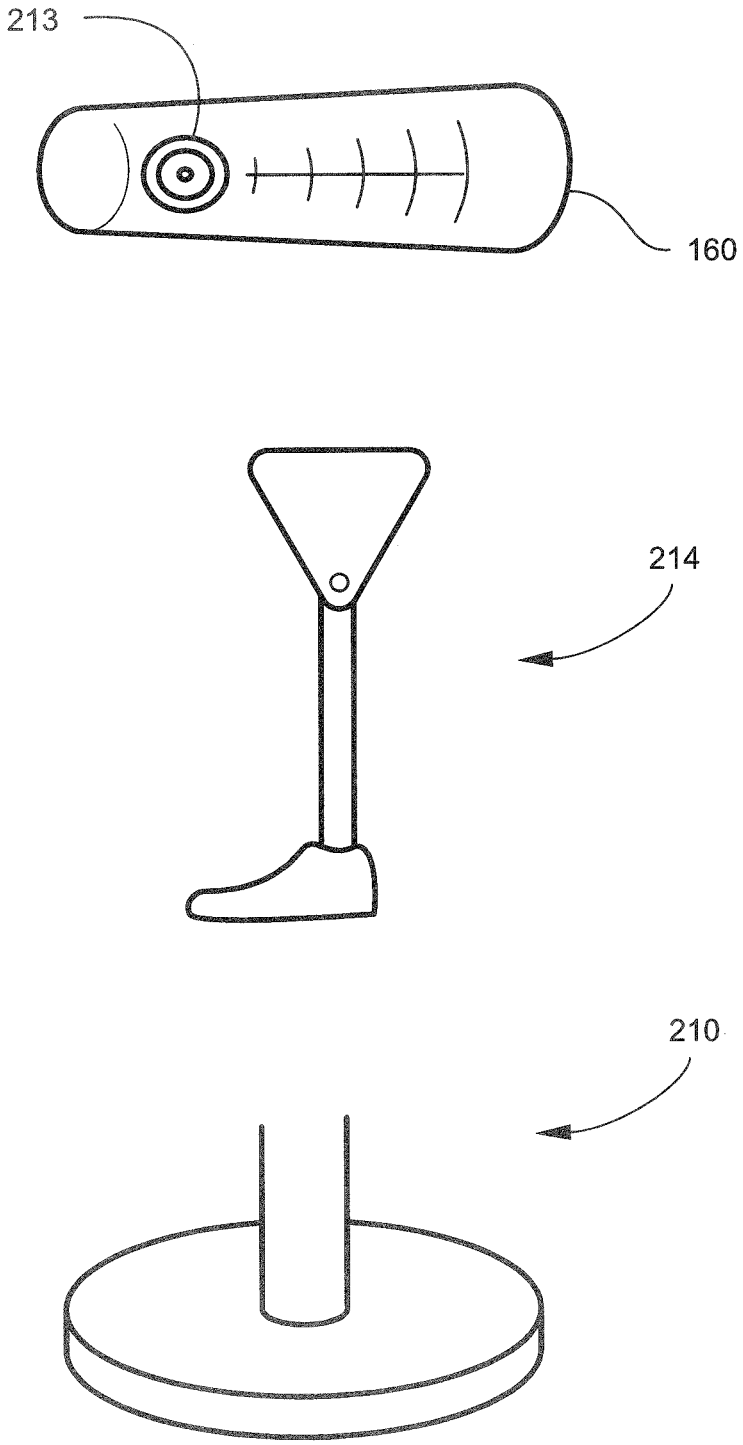
FIG. 4 is an accessory view of the game device of FIG. 1, according to an embodiment of the present disclosure.

FIG. 4 is another view of the game device of FIG. 1, according to an embodiment of the present disclosure. Here shown are conceived accessories for use with the game device 100. A sleeve 160 is included with the game device 100 that is configured to be worn by a user and used to propel the simulated soccer ball 150 (FIG. 2). The sleeve 160 may comprise a material that has elastic properties, enabling resilient reformation for a given application. In this sense, the sleeve 160 may be configured to be attached to the arm of the user, and alternatively, a finger of a user. Attachment and wearability of the sleeve 160 is determined by material, size, application, and preference. The sleeve 160 may include indicia used for aiming 213. The sleeve 160 may further include an attachment 214 that is configured to be in physical communication with the simulated soccer ball 150. In various embodiments, the sleeve may comprise an elastic material having an elastic property such as, for example, one of a rubber, a synthetic rubber, a polyester, a polyether-polyurea copolymer, and/or the like. An embodiment of an attachment 214 is shown having a simulated shoe that pivots with gravitational force. Various renditions and designs for the attachment 214 functionality are also considered. It is disclosed that an attachment 214 to the sleeve 160 comprises a device where the orientation in space, or structure, is physically manipulated during gameplay to propel the simulated soccer ball 150 (FIG. 2). Alternative means of propelling the simulated soccer ball 150 (FIG. 2) may include a launching mechanism 210. The launching mechanism 210 may be configured to exert a force of the simulated soccer ball 150 (FIG. 2). A conceived launching mechanism 210 is illustrated in the form of a flywheel. In this embodiment, the flywheel retains a rotational energy that may be used during gameplay to propel the simulated soccer ball 150 (FIG. 2). Various embodiments of the launching mechanism 210 include electronic solenoids, motors, and all means of transferring energy from the launching mechanism 210 to the simulated soccer ball 150 (FIG. 2). As one could imagine, rules may dictate that only predetermined energy values that are stored in the flywheel are may be used through the course of gameplay.

There is also disclosed a method for playing a game, according to an embodiment of the present disclosure. In particular, the method for playing a game may include one or more components or features of the game device 100 as described above. As illustrated, the method for playing a game may include the steps of: step one, providing a game device; step two, attaching a plurality of elongate pieces to a substantially rectangular rigid planar surface; step three, moving a simulated soccer ball towards one of a pair of nets; step four, rearranging the plurality of elongate pieces.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A game device comprising:

a substantially rectangular rigid planar surface which has a plurality of apertures disposed thereon, the plurality of apertures including at least a first row of four apertures, a second row of four apertures, a third row of four apertures, and a fourth row of four apertures;

a plurality of elongate pieces, each of which has at least one end sized to mate with any of said plurality of apertures allowing said elongate piece to maintain a perpendicular orientation to said substantially rectangular rigid planar surface;

a simulated soccer field which is sized and dimensioned to be disposed on said substantially rectangular rigid planar surface, wherein the first row of four apertures extends orthogonal to a sideline of the simulated soccer field and across a first penalty area of the simulated soccer field, wherein the second row of four apertures extends orthogonal to the sideline and across a first penalty arc of the simulated soccer field, wherein the third row of four apertures extends orthogonal to the sideline of the simulated soccer field and across a second penalty area of the simulated soccer field, wherein the fourth row of four apertures extends orthogonal to the sideline and across a second penalty arc of the simulated soccer field, wherein the first penalty area encompasses only two of the apertures of the first row of four apertures, wherein the second penalty area encompasses only two of the apertures of the third row of apertures;

a pair of nets coupled to the substantially rectangular rigid planar surface, wherein each net of the pair of nets is coupled in surrounding relation to a catch basin associated with the respective net, wherein the area of the catch basin is defined on the substantially rectangular rigid planar surface and within the net, wherein the catch basis extends below the net and into the substantially rectangular rigid planar surface;

a ball; and a sleeve configured to attach to a finger of a user, wherein the sleeve comprises an attachment that pivots with gravitational force configured to propel the ball.

2. The game device of claim 1, further comprising an elastic border that is configured to be disposed along a periphery of the substantially rectangular rigid planar surface.

3. The game device of claim 1, further comprising supports configured to elevate the substantially rectangular rigid planar surface.

4. The game device of claim 1, further comprising ornamental dressings configured to attach to said plurality of elongate pieces.

5. The game device of claim 1, wherein the attachment comprises a simulated shoe.

6. The game device of claim 1, wherein the sleeve comprises a material having an elastic property.

7. The game device of claim 1, wherein the sleeve includes indicia used for aiming.

8. The game device of claim 1, wherein said plurality of apertures include corresponding plugs.

9. The game device of claim 1, wherein said simulated soccer field is removably replaceable from said substantially rectangular rigid planar surface.

10. The game device of claim 1, further comprising a scoring apparatus.

11. The game device of claim 1, wherein said pair of nets comprise a rigid material.

12. A soccer game device comprising:

a substantially rectangular rigid planar surface, said substantially rectangular rigid planar surface having a plurality of apertures disposed thereon, the plurality of apertures including at least a first row of four apertures, a second row of four apertures, a third row of four apertures, and a fourth row of four apertures, a plurality of elongate pieces, said plurality of elongate pieces having at least one end sized to mate with any of said plurality of apertures allowing said elongate piece to maintain a perpendicular orientation to said substantially rectangular rigid planar surface, a simulated soccer field, said simulated soccer field is sized and dimensioned to be disposed on said substantially rectangular rigid planar surface, wherein the first row of four apertures extends orthogonal to a sideline of the simulated soccer field and across a first penalty area of the simulated soccer field, wherein the second row of four apertures extends orthogonal to the sideline and across a first penalty arc of the simulated soccer field, wherein the third row of four apertures extends orthogonal to the sideline of the simulated soccer field and across a second penalty area of the simulated soccer field, wherein the fourth row of four apertures extends orthogonal to the sideline and across a second penalty arc of the simulated soccer field, wherein the first penalty area encompasses only two of the apertures of the first row of four apertures, wherein the second penalty area encompasses only two of the apertures of the third row of apertures;

a pair of nets, coupled to said substantially rectangular rigid planar surface, wherein each net of the pair of nets is coupled in surrounding relation to a catch basin associated with the respective net, wherein the area of the catch basin is defined on the substantially rectangular rigid planar surface and within the net, wherein the catch basis extends below the net and into the substantially rectangular rigid planar surface, a simulated soccer ball, said simulated soccer ball being substantially scaled with respect to said simulated soccer field, and, a sleeve configured to be worn by a user, wherein the sleeve comprises an attachment that pivots with gravitational force configured to propel the simulated soccer ball;

further comprising an elastic border that is configured to be disposed along a periphery of the substantially rectangular rigid planar surface;

further comprising supports configured to elevate said game;

further comprising ornamental dressings configured to attach to said plurality of elongate pieces;

further comprising a scoring apparatus;

wherein said sleeve is configured to attach to a finger of the user;

wherein said sleeve comprises a material having an elastic property;

wherein said plurality of apertures include corresponding plugs;

wherein said simulated soccer field is removably replaceable from said substantially rectangular rigid planar surface; and wherein said pair of nets comprise a rigid material.

13. The game device of claim 12, further comprising a set of instructions;

and wherein the game is arranged as a kit.

* * * * *